US008596778B2

(12) United States Patent
Kato

(10) Patent No.: US 8,596,778 B2
(45) Date of Patent: Dec. 3, 2013

(54) INK JET RECORDING APPARATUS

(75) Inventor: Shigeki Kato, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 408 days.

(21) Appl. No.: 12/892,718

(22) Filed: Sep. 28, 2010

(65) Prior Publication Data

US 2011/0128339 A1 Jun. 2, 2011

(30) Foreign Application Priority Data

Nov. 30, 2009 (JP) ..... 2009-272531

(51) Int. Cl.
*B41J 2/01* (2006.01)
*B41J 29/38* (2006.01)

(52) U.S. Cl.
USPC ..... 347/104; 347/16

(58) Field of Classification Search
None
See application file for complete search history.

(56) References Cited

U.S. PATENT DOCUMENTS

| | | | | |
|---|---|---|---|---|
| 6,309,064 | B1 | 10/2001 | Tanno et al. | |
| 7,559,642 | B2 * | 7/2009 | Shigemura | 347/104 |
| 7,611,238 | B2 * | 11/2009 | Nishida | 347/104 |
| 2006/0187289 | A1 * | 8/2006 | Nakashima | 347/104 |

FOREIGN PATENT DOCUMENTS

| | | | |
|---|---|---|---|
| EP | 0693381 | A1 | 1/1996 |
| JP | H07-330185 | A | 12/1995 |
| JP | H11-151822 | A | 6/1999 |

OTHER PUBLICATIONS

Japan Patent Office, Notification of Reasons for Rejection for Japanese Patent Application No. 2009-272531 (counterpart to above-captioned patent application), mailed May 21, 2013.

* cited by examiner

*Primary Examiner* — Stephen Meier
*Assistant Examiner* — Alexander C Witkowski
(74) *Attorney, Agent, or Firm* — Baker Botts L.L.P.

(57) ABSTRACT

An ink jet recording apparatus may include a conveying device configured to move a conveying belt including a conveying surface to convey a recording medium. The ink jet recording apparatus may include a recording head configured to discharge ink onto the recording medium. The ink jet recording apparatus may include an attraction device including first and second electrodes facing a surface opposite the conveying surface and configured to apply a voltage between the first and second electrodes. The ink jet recording apparatus may include a contact member which comes into contact with the conveying surface. The first and second electrodes may be disposed at a distance from each other in the width direction of the conveying belt. A contacting area of the conveying surface with which the contact member comes into contact may not extend over the first and second electrodes in the width direction.

10 Claims, 8 Drawing Sheets

INK JET RECORDING APPARATUS

CROSS REFERENCE TO RELATED APPLICATION

This application claims priority to Japanese Patent Application No. 2009-272531, filed Nov. 30, 2010, the entire subject matter and disclosure of which is incorporated herein by reference.

BACKGROUND OF THE DISCLOSURE

1. Field of the Disclosure

The features described herein relate generally to ink jet recording apparatuses that convey recording media by attracting them to a conveying device.

2. Description of Related Art

An ink jet recording apparatus which conveys recording media to a recording head by attracting them to a conveying belt is known. The ink jet recording apparatus attracts a recording medium to a conveying surface using electrodes disposed in the conveying belt.

The above-described ink jet recording apparatus includes a member that comes into contact with a conveying belt, such as a sheet-pressing member. It may cause ink adhered to the conveying belt to spread in the moving direction of the conveying belt. Therefore, the spread ink may cause a short-circuit between the electrodes.

SUMMARY OF THE DISCLOSURE

According to one embodiment herein, an ink jet recording apparatus may include a conveying device configured to move a conveying belt to convey a recording medium, the conveying belt including a conveying surface on which the recording medium is placed. The ink jet recording apparatus may include a recording head configured to discharge ink onto the recording medium conveyed by the conveying device. The ink jet recording apparatus may include an attraction device including first and second electrodes facing a surface opposite the conveying surface and configured to apply a voltage between the first and second electrodes to attract the recording medium to the conveying surface. The ink jet recording apparatus may include a contact member which comes into contact with the conveying surface. The first and second electrodes may be disposed at a distance from each other in the width direction of the conveying belt perpendicular to the conveying direction of the recording medium. A contacting area of the conveying surface with which the contact member comes into contact may not extend over the first and second electrodes in the width direction.

According to another embodiment herein, an ink jet recording apparatus may include a conveying device configured to move a conveying belt to convey a recording medium, the conveying belt including a conveying surface on which the recording medium is placed. The ink jet recording apparatus may include a recording head configured to discharge ink onto the recording medium conveyed by the conveying device. The ink jet recording apparatus may include an attraction device including first and second electrodes provided inside the conveying belt and configured to apply a voltage between the first and second electrodes to attract the recording medium to the conveying surface, the first and second electrodes sandwiching part of the conveying belt between the recording medium on the conveying surface and the first and second electrodes. The ink jet recording apparatus may include a contact member which comes into contact with the conveying surface. The first and second electrodes may be disposed at a distance from each other in the width direction of the conveying belt perpendicular to the conveying direction of the recording medium. A contacting area of the conveying surface with which the contact member comes into contact may not extend over the first and second electrodes in the width direction.

Other objects, features and advantages will be apparent to persons of ordinary skill in the art from the following description with reference to the accompanying drawings.

DETAILED DESCRIPTION

Various embodiments, and their features and advantages, may be understood be referring to FIGS. 1-8, like numerals being used for corresponding parts in the various drawings.

Figure 1:
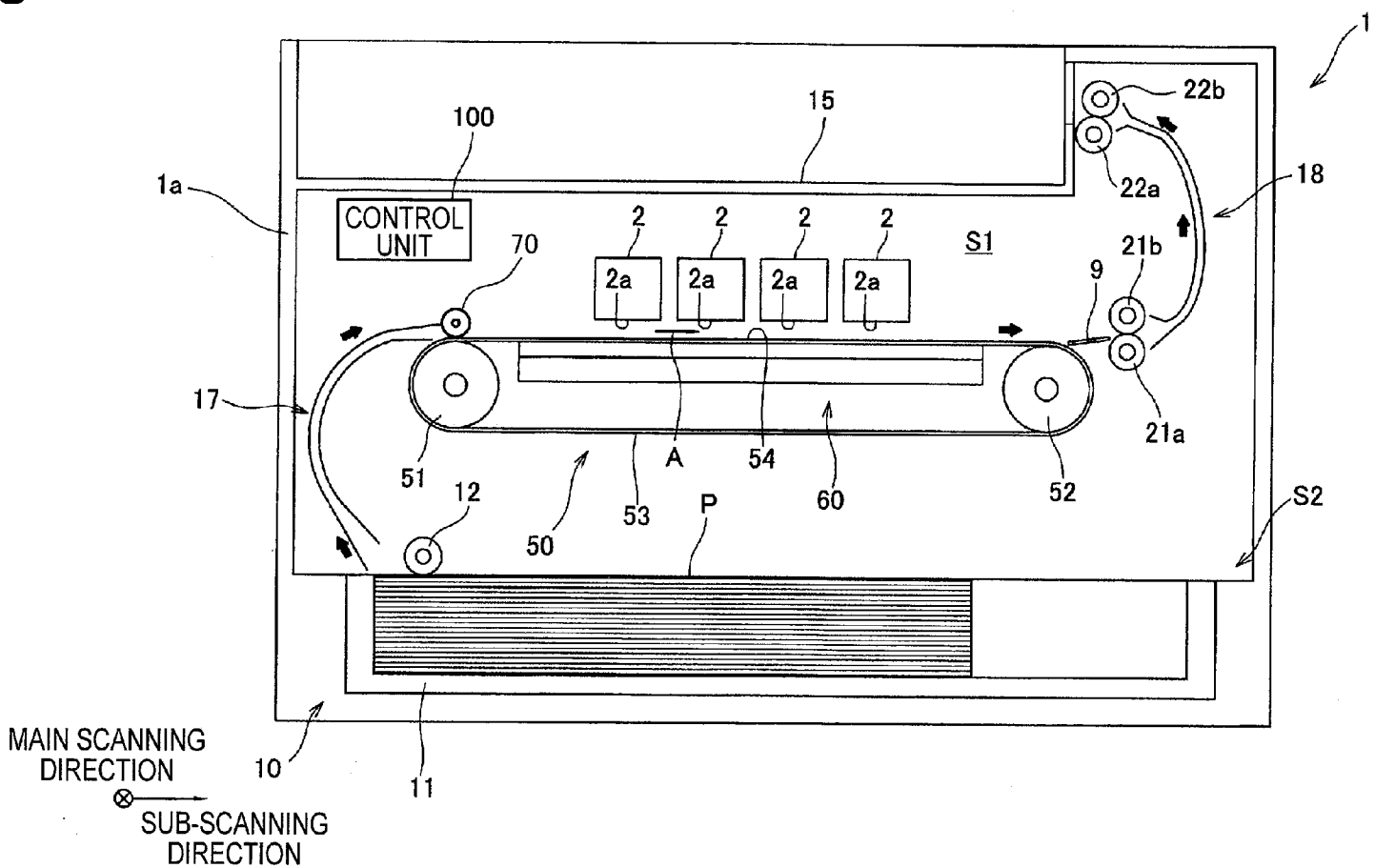
FIG. 1 is a schematic view schematically showing the internal configuration of an ink jet printer according to one embodiment.

Referring to FIG. 1, an ink jet printer 1 according to an embodiment may include a rectangular-parallelepiped-shaped housing 1*a* having a sheet-output portion 15 on top thereof. The inside of the housing 1*a* may be divided into two, namely, from the top, a space S1 and a space S2. The space S1 may accommodate, from the top, a plurality of, e.g., four, ink jet heads 2 that discharge magenta ink, cyan ink, yellow ink, and black ink, and a conveying mechanism 50 that conveys a sheet P in a conveying direction A. The space S2 may accommodate a sheet-feed unit 10. Furthermore, the ink jet printer 1 may include a control unit 100 that controls the operations of these components. In this embodiment, the direction parallel to the conveying direction A, in which the sheet P is conveyed by the conveying mechanism 50, is defined as the sub-scanning direction, and the direction perpendicular to the sub-scanning direction and along the horizontal surface is defined as the main scanning direction.

A sheet conveying path may be formed in the ink jet printer 1, along which the sheet P is conveyed from the sheet-feed unit 10 to the sheet-output portion 15, as indicated by thick arrows in FIG. 1. The sheet-feed unit 10 may include a sheet-feed cassette 11 that can accommodate a stack of sheets P, a sheet-feed roller 12 that feeds the sheets P from the sheet-feed cassette 11, and a sheet-feed motor (not shown) that rotates the sheet-feed roller 12 under the control of the control unit 100.

The sheet-feed roller 12 may feed the sheet P on the top of the stack of sheets P stored in the sheet-feed cassette 11. A conveyance guide 17 that extends upward in a curved manner from the sheet-feed cassette 11 may be provided on the left side of the conveying mechanism 50 in FIG. 1.

In this configuration, by rotating the sheet-feed roller 12 clockwise in FIG. 1 under the control of the control unit 100, the sheet P in contact with the sheet-feed roller 12 may be fed to the conveying mechanism 50 through the conveyance guide 17.

Figure 2:
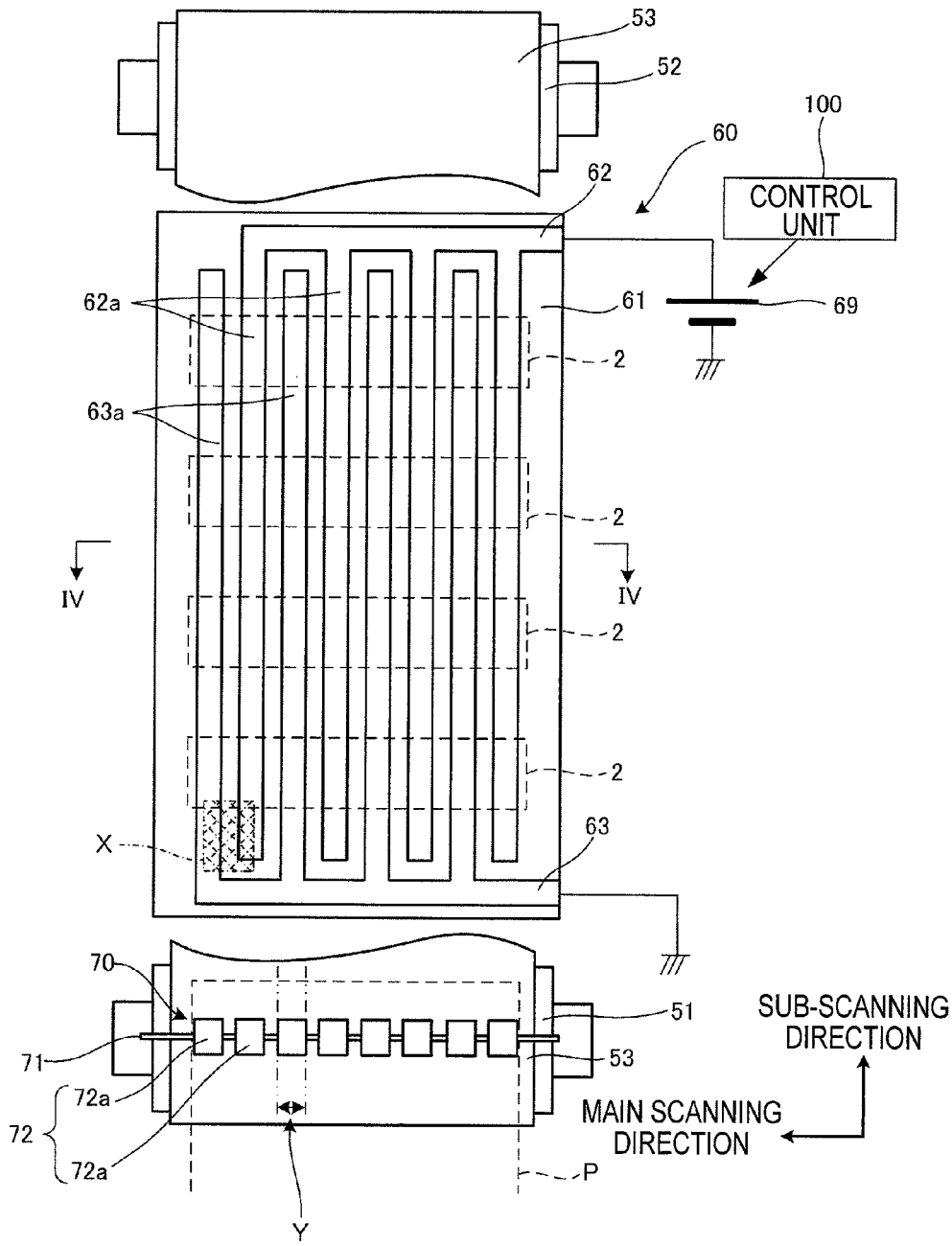
FIG. 2 is a plan view of a conveying mechanism and the vicinity thereof in FIG. 1, in which a part of the conveying belt is cut out to show an attraction platen therebeneath.
Figure 3:
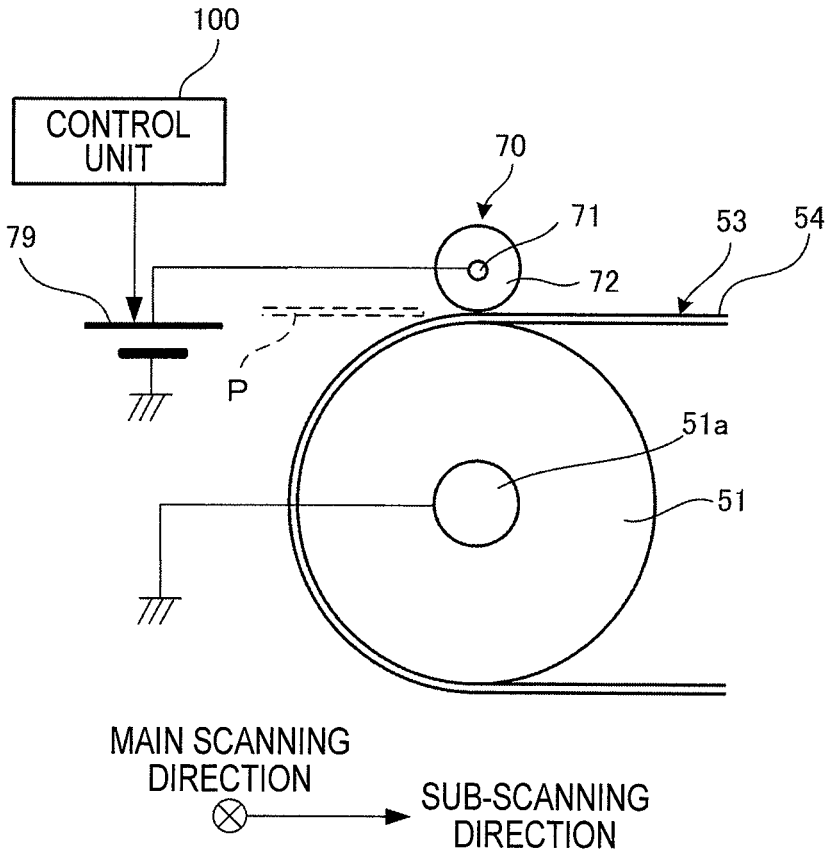
FIG. 3 is an enlarged view of a charging roller and the vicinity thereof in FIG. 1.

Referring to FIGS. 1 and 2, the conveying mechanism 50 may be disposed at a position facing the plurality of, e.g., four, ink jet heads 2. The conveying mechanism 50 may include a plurality of, e.g., two, belt rollers 51 and 52, an endless conveying belt 53 stretched between and wound around the rollers 51 and 52, a conveying motor (not shown) that rotates the belt roller 52 under the control of the control unit 100, and an attraction platen 60 facing the plurality of, e.g., four, ink jet heads 2. The plurality of, e.g., two, belt rollers 51 and 52 may be disposed in the conveying direction A and may be supported by the housing 1*a* so as to be rotatable. The upper surface of the attraction platen 60 may be disposed at substantially the same height as the upper ends of the belt rollers 51 and 52, and the conveying belt 53 may be stretched between the belt rollers 51 and 52 horizontally.

The conveying belt 53 may be flexible. The conveying belt 53 may include, for example, polyimide or fluoroplastic, and may have a volume resistivity of about 108 to 1014 Ωcm (for example, about 1012 Ωcm). The conveying belt 53 may be made of any material as long as it provides the above-described volume resistivity and flexibility.

Referring to FIGS. 2 and 4, the attraction platen 60 may include a plate-like base member 61 composed of an insulating material, and electrodes 62 and 63 attached to an upper surface 61*a* thereof. The electrodes 62 and 63 may include a plurality of interdigital portions 62*a* and 63*a* extending in the conveying direction A. The interdigital portions 62*a* and 63*a* may be arranged alternately in the main scanning direction in an interdigital shape. The area provided with the electrodes 62 and 63 may have substantially the same width as the sheet P in the main scanning direction and may be larger than the area provided with the ink jet heads 2 in the sub-scanning direction. The upper surfaces of the electrodes 62 and 63 may be formed horizontally and may be disposed at the same height. The electrode 62 may be connected to a power source 69 provided in the housing 1*a*, and the electrode 63 may be connected to the ground. The power source 69 may be controlled by the control unit 100. The electrodes 62 and 63 may include a material having high electrical conductivity, such as metal. A protection layer including a resin material or the like may be formed on the upper surfaces of the electrodes 62 and 63.

Figure 4A:
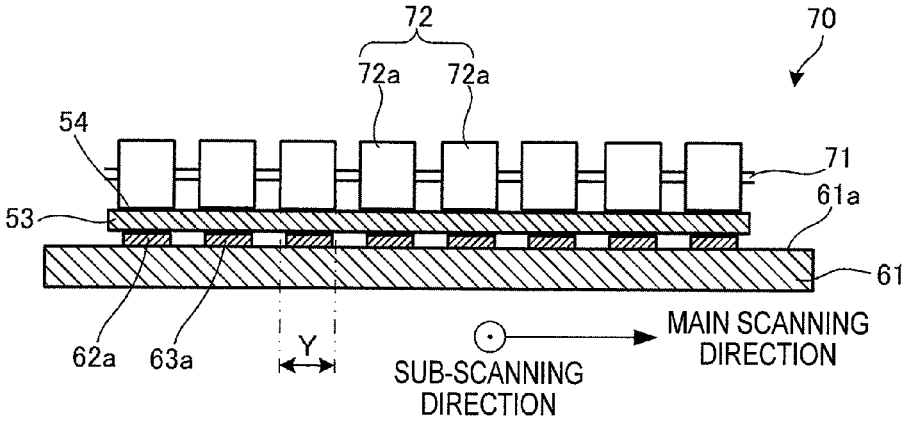
FIG. 4A is a cross-sectional view taken along line IV-IV in FIG. 2.
Figure 4B:
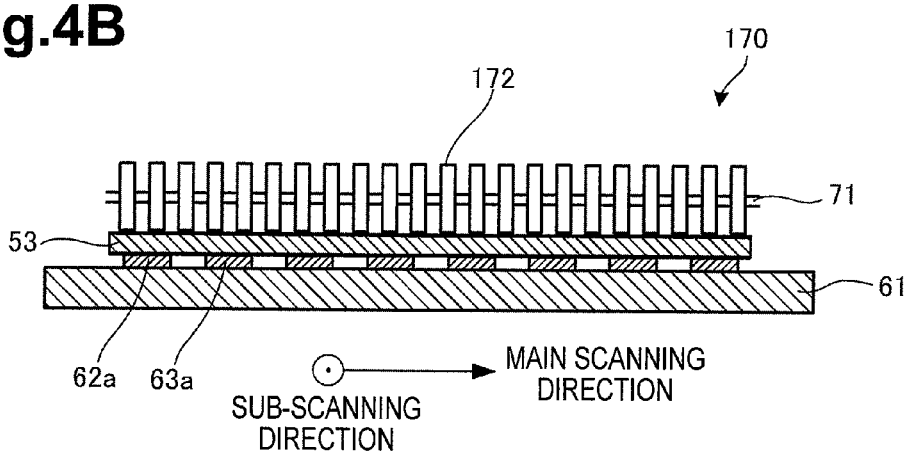
FIG. 4B is a cross-sectional view showing another embodiment different from FIG. 4A.

A charging roller 70 may be disposed at the upstream end of the attraction platen 60, at a position facing the belt roller 51. The charging roller 70 may be urged downward and may be pressed against an outer circumferential surface 54 of the conveying belt 53. The charging roller 70 may generally have a cylindrical shape whose axial direction is aligned with the main scanning direction. The charging roller 70 may extend substantially from one end to the other end of the conveying belt 53 in the main scanning direction. Referring to FIGS. 4A and 4B, the charging roller 70 may include a rotation shaft 71 and a roller body 72 fixed to the outer circumference thereof. The rotation shaft 71 and the roller body 72 may include metal having high electrical conductivity or a semiconductive material having a certain electrical conductivity. The rotation shaft 71 may be connected to a power source 79, and the power source 79 may be controlled by the control unit 100. On the other hand, a rotation shaft 51*a* of the belt roller 51 may be connected to the ground. Both the belt roller 51 and the rotation shaft 51*a* may include a material having high electrical conductivity, and, the belt roller 51 may have a ground potential by connecting the rotation shaft 51*a* to the ground.

In this configuration, the conveying belt 53 may be rotated by rotating the belt roller 52 clockwise in FIG. 1 under the control of the control unit 100. On the other hand, the sheet P fed from the sheet-feed unit 10 may be attracted to the outer circumferential surface 54 of the conveying belt 53 by the charging roller 70, the belt roller 51, and the attraction platen 60, as follows. First, the sheet P may be nipped between the outer circumferential surface 54 of the conveying belt 53 and the charging roller 70. Because the charging roller 70 is urged downward, the sheet P may be pressed against the outer circumferential surface 54. At this time, if a predetermined level of voltage is supplied to the rotation shaft 71 of the charging roller 70, electric discharge from the charging roller 70 to the sheet P may occur, causing the sheet P to be positively charged. On the other hand, negative charges may be supplied to the conveying belt 53 through the belt roller 51 connected to the ground, negatively charging the conveying belt 53. Thus, the positively charged sheet P may be electrostatically attracted to the negatively charged outer circumferential surface 54 of the conveying belt 53.

The sheet P attracted to the outer circumferential surface 54 by the electric discharge from the charging roller 70 may be conveyed above the attraction platen 60 along with the movement of the conveying belt 53. At the attraction platen 60, a positive potential may be applied to the electrode 62 and a ground potential may be applied to the electrode 63 under the control of the control unit 100. Any configuration may be employed as long as it generates any potential difference between the electrodes 62 and 63. For example, a negative potential may be applied to the electrode 62, or, a ground potential may be applied to the electrode 62 while applying another potential to the electrode 63.

Figure 5B:
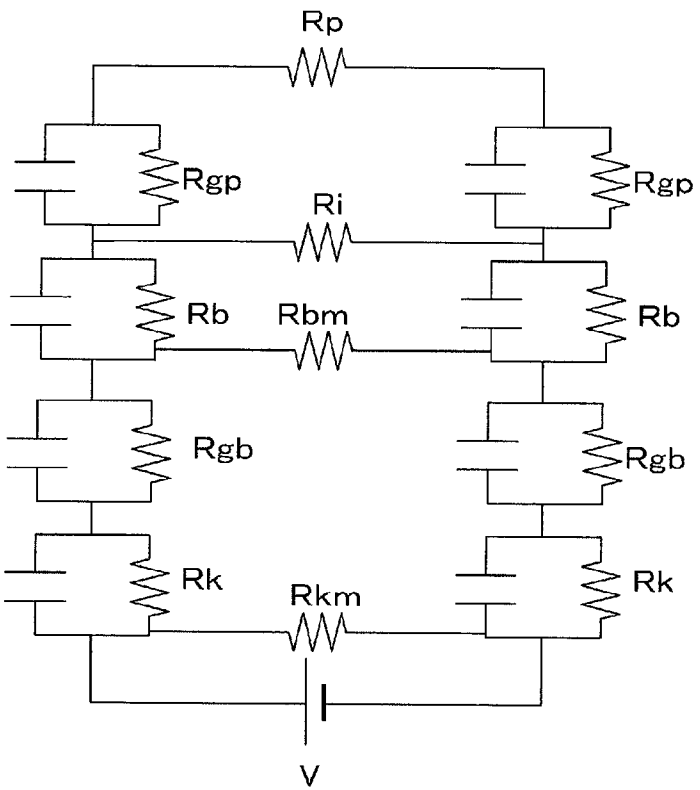
FIG. 5B shows an electric circuit at the time when a partial short-circuit occurs in the electric circuit formed in this embodiment.
Figure 5A:
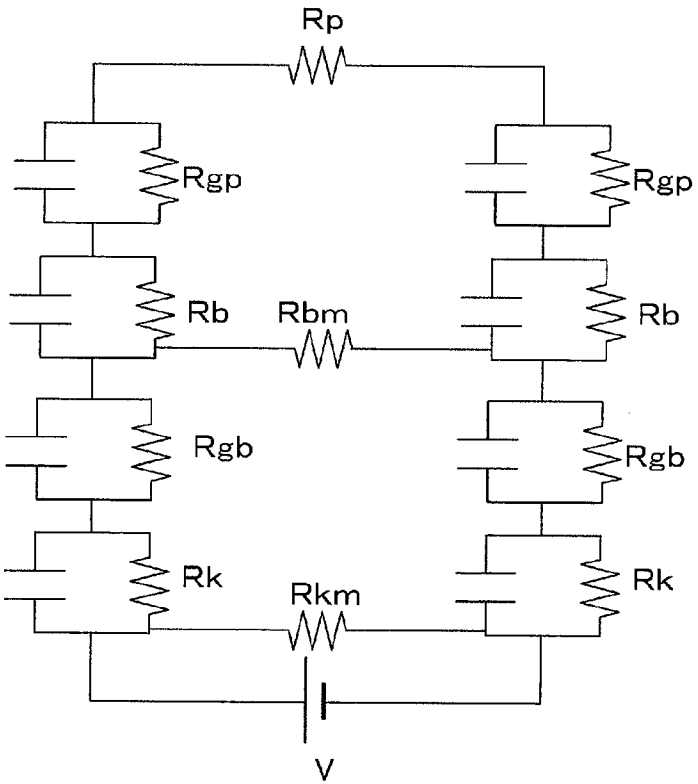
FIG. 5A shows an electric circuit formed between a recording medium, an attraction platen, and a conveying mechanism according to this embodiment.

When a voltage is applied between the electrodes 62 and 63, a current may flow between the electrodes 62 and 63 through the conveying belt 53 and the sheet P. FIG. 5A shows an electric circuit at the time when a voltage V is applied between the electrodes 62 and 63. The electric circuit shown in FIG. 5A is one example that can be considered when this embodiment is idealized as an electrical configuration.

This electric circuit may include a main path from the electrode 62, to the conveying belt 53, to the sheet P, to the conveying belt 53, to the electrode 63. In FIG. 5A, reference signs Rk, Rgb, Rb, Rgp, and Rp represent the electric resistances of respective parts in the main path. More specifically, Rk corresponds to the electric resistance of the protection layer formed on the upper surfaces of the electrodes 62 and 63. Rgb corresponds to the electric resistance of the gap between the protection layer and the conveying belt 53. Rb corresponds to the electric resistance of the conveying belt 53. Rgp corresponds to the electric resistance of the gap between the conveying belt 53 and the sheet P. Rp corresponds to the electric resistance of the sheet P.

This electric circuit may include bypass paths connected in parallel to the main path, and reference signs Rkm and Rbm indicate the electric resistances of these bypass paths. More specifically, Rkm indicates the electric resistance of the bypass path connecting the electrodes 62 and 63 via the protection layer. Rbm indicates the electric resistance of the bypass path connecting the electrodes 62 and 63 via the conveying belt 53 but not via the sheet P.

Referring to FIG. 5A, capacitors connected in parallel to the electric resistances may be formed in the electric circuit. When a voltage is applied between the electrodes 62 and 63, a minute current may flow through the gap between the sheet P and the conveying belt 53, generating a potential difference in this gap. As a result, an attraction force due to Johnsen-Rahbeck force may be generated between the sheet P and the conveying belt 53. By this attraction force, the sheet P on the conveying belt 53 may be electrostatically attracted to the outer circumferential surface 54.

The reason why the conveying belt 53 includes a material having certain high volume resistivity, as described above, is as follows. If the electric resistance of the conveying belt 53 is small, the electric resistance Rbm of the bypass path connecting the electrodes 62 and 63 via the conveying belt 53 is small, making it easy for the current to flow through the bypass path but difficult to flow through the sheet P. On the other hand, if the electric resistance of the conveying belt 53 is too large, it is difficult for the current to flow from the conveying belt 53 to the sheet P. Accordingly, the attraction force due to Johnsen-Rahbeck force is small if the electric resistance of the conveying belt 53 is too small or too large.

The sheet P fed from the sheet-feed unit 10 may be conveyed in the conveying direction A while being attracted to the outer circumferential surface 54 by the attraction force of the charging roller 70 and attraction platen 60. Furthermore, at this time, when the sheet P conveyed while being attracted to the outer circumferential surface 54 of the conveying belt 53 passes immediately below the plurality of, e.g., four, ink jet heads 2 (i.e., an area facing a discharge surface 2*a*), the ink jet heads 2 may discharge ink of different colors onto the sheet P, under the control of the control unit 100. Thus, a desired color image may be formed on the sheet P.

When a printing sheet having a size different from the specified size is used, or when a paper jam occurs, ink discharged from the ink jet heads 2 may be adhered to the outer circumferential surface 54 of the conveying belt 53. If the portion of the outer circumferential surface 54 of the conveying belt 53 where the ink is adhered is conveyed to a position facing the attraction platen 60, and, if that portion extends over the interdigital portions 62*a* and 63*a*, as an area X in the FIG. 2, the electrodes 62 and 63 may be short-circuited. That is, if the ink adhered to the conveying belt 53 spreads over the interdigital portions 62*a* and 63*a*, a bypass path indicated by the resistance Ri, which short-circuits the main path, may be formed because of a current passing through the adhered ink, not the sheet P (resistance Rp), as indicated by a resistance Ri in FIG. 5B. If such a bypass path is formed, the current may mainly flow through the resistance Rp and may be less likely to flow through the resistance Ri because the resistance Ri of the ink is smaller than the resistance Rp of the sheet P. Thus, the attraction force for attracting the sheet P to the conveying belt 53 may decrease.

Referring to FIGS. 2 and 4A, the roller body 72 of the charging roller 70 may be divided into several segments in the main scanning direction. That is, the roller body 72 may include a plurality of roller segments 72*a* arranged at intervals. Each roller segment 72*a* may have a cylindrical shape whose axial direction is aligned with the main scanning direction, and the rotation shaft 71 may be fixed to the center of the cylinder. The roller segments 72*a* may be disposed such that the areas of the outer circumferential surface 54 of the conveying belt 53 with which the roller segments 72*a* can be brought into contact do not extend over the interdigital portions 62*a* and 63*a* in the main scanning direction. The areas of the outer circumferential surface 54 of the conveying belt 53 with which the roller segments 72*a* can be brought into contact may be the entire areas defined by an area Y in FIG. 2, corresponding to the width of the roller segment 72*a* in the main scanning direction, extended along the conveying belt 53. That is, the roller body 72 may be disposed such that the above-described areas do not extend over the interdigital portions 62*a* and 63*a*.

It is also possible that, as shown in a charging roller 170 in FIG. 4B, a roller body 172 is composed of a plurality of thin disc-like rollers such that they do not extend over the interdigital portions 62*a* and 63*a* in the main scanning direction.

The charging roller 70 is urged against the outer circumferential surface 54 of the conveying belt 53. Therefore, if ink is adhered to the outer circumferential surface 54, the ink adhered to the outer circumferential surface 54 may be spread by the charging roller 70 when the conveying belt 53 is conveyed. To counter this, the embodiment described above is configured such that the areas with which the roller segments 72*a* can be brought into contact do not extend over the interdigital portions 62*a* and 63*a* in the main scanning direction. Thus, even if the charging roller 70 spreads ink on the outer circumferential surface 54, the spread ink may tend to stay within the area corresponding to the width of each roller segment 72*a* (i.e., the area Y in FIG. 2). Referring to FIG. 4A, these areas may extend over one of the interdigital portions 62*a* and 63*a*, but may not over the other of them. Accordingly, the spread ink may be less likely to cause a short-circuit between the electrodes 62 and 63, whereby a problem of a decrease in the attraction force for attracting the sheet P to the conveying belt 53 may be less likely to occur. The same holds in the case where the charging roller 170 in FIG. 4B may be employed.

Figure 6A:
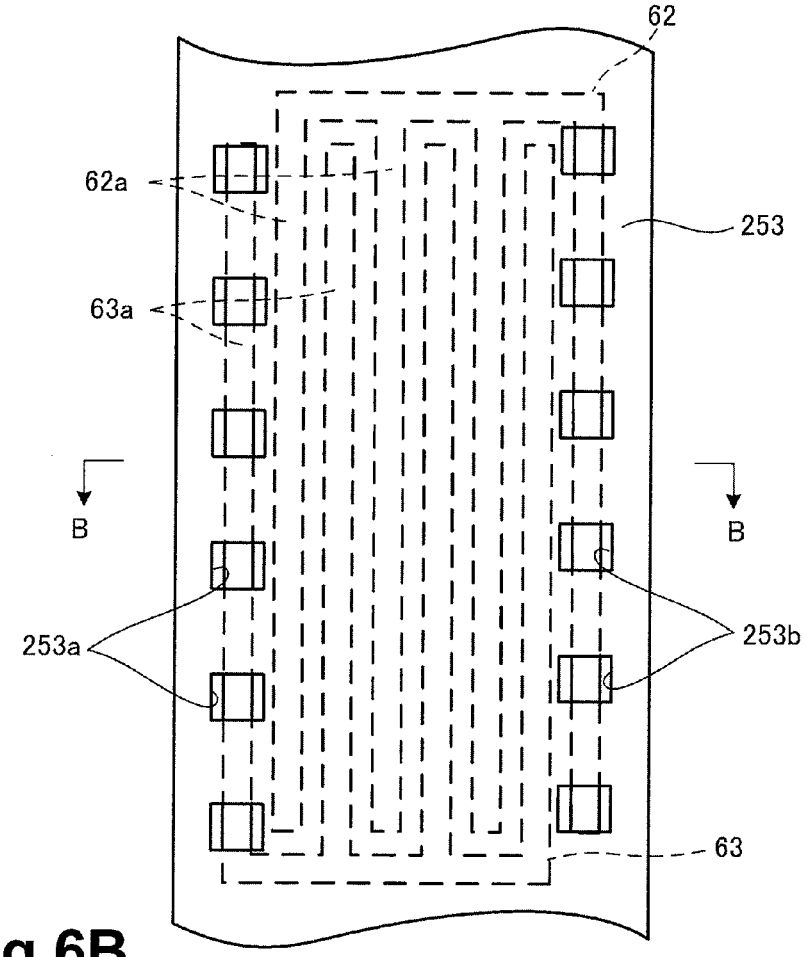
FIG. 6A is a plan view of a conveying belt according to another embodiment.
Figure 6B:
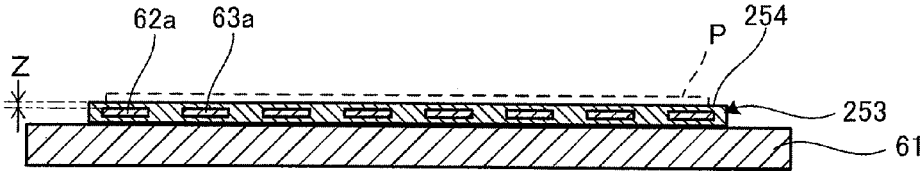
FIG. 6B is a cross-sectional view taken along line B-B in FIG. 6A.

Referring to FIG. 6, another embodiment will be described. Although the attraction platen 60 may be provided as an attraction mechanism in the embodiment described above, the attraction mechanism is provided on the conveying belt side in this embodiment. More specifically, although a conveying belt 253 according to this embodiment may be an endless belt stretched between and wound around the rollers 51 and 52, similarly to the conveying belt 53 according to the embodiment described above, the electrodes 62 and 63 may be provided inside the conveying belt 253. Referring to FIG. 6B, the electrodes 62 and 63 may be disposed such that a portion of the conveying belt 253 (i.e., a portion denoted by Z in FIG. 6B) is sandwiched between the electrodes 62 and 63 and the sheet P disposed on an outer circumferential surface 254 of the conveying belt 253.

The outer circumferential surface 254 of the conveying belt 253 may have a plurality of recesses 253*a* and 253*b*. The recesses 253*a* may be arranged along the interdigital portion 63*a* disposed on the extreme left side in FIG. 6A. The recesses 253*b* may be arranged along the interdigital portion 62*a* disposed on the extreme right side in FIG. 6A. The interdigital portion 63*a* may be exposed from the recesses 253*a*. The interdigital portion 62*a* may be exposed from the recesses 253*b*. This configuration may enable a voltage to be applied between the electrodes 62 and 63 by providing brush electrodes that come into contact with the interdigital portions 62*a* and 63*a* through the recesses 253*a* and 253*b* from above the conveying belt 253.

In this embodiment too, the roller body 72 of the charging roller 70 may be disposed such that it does not extend over the interdigital portions 62*a* and 63*a* in the main scanning direction. Therefore, even if the charging roller 70 spreads ink on the outer circumferential surface 254, the spread ink may be less likely to be spread over the interdigital portions 62*a* and 63*a*. Accordingly, ink on the outer circumferential surface 254 may be less likely to cause a short-circuit between the electrodes 62 and 63, making a problem of a decrease in the attraction force for attracting the sheet P to the conveying belt 253 less likely to occur.

Figure 7:
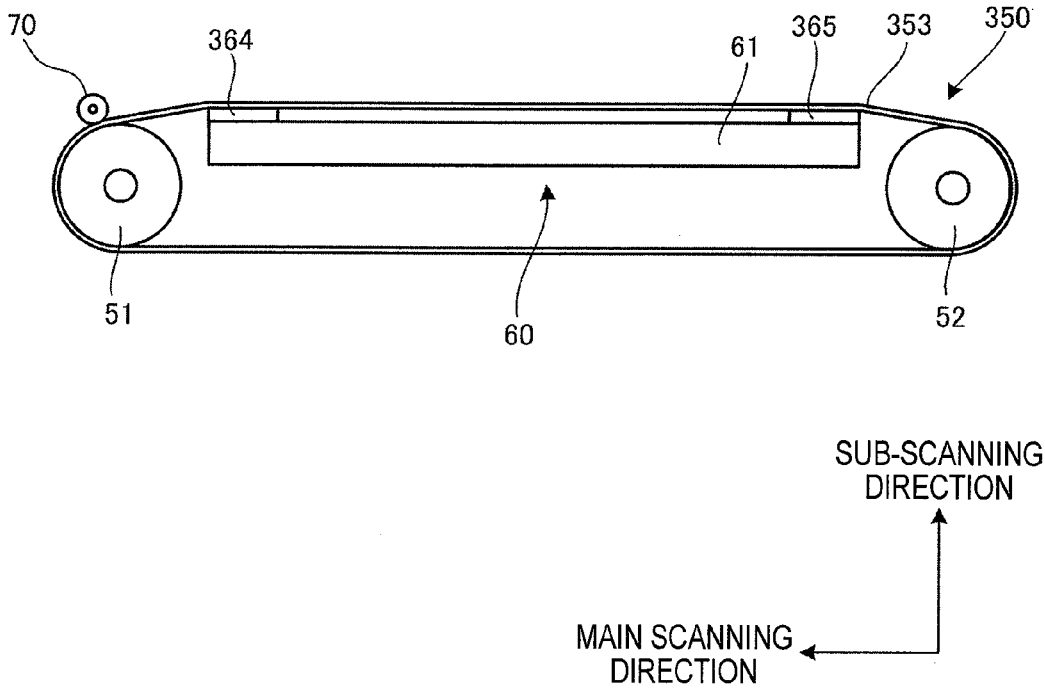
FIG. 7 is a front view of a conveying mechanism according to another embodiment.

Referring to FIG. 7, another embodiment will be described. A conveying mechanism 350 according to this embodiment may include the belt rollers 51 and 52, an endless conveying belt 353 stretched between the belt rollers 51 and 52, and the attraction platen 60. The upper surface of the attraction platen 60 may be disposed above the upper ends of the belt rollers 51 and 52, whereby the conveying belt 353 runs along a path projecting upward from the belt roller 51 and 52. The conveying belt 353 may be subjected to a greater tension by the attraction platen 60 compared with the case of the embodiment described above. This tension may be particularly great at the corners of the attraction platen 60 in the main scanning direction. Accordingly, charging due to friction may occur at the corners, causing the conveying belt 353 to be attracted to the attraction platen 60 and increasing the running load of the conveying belt 353 to an excessive level.

In this embodiment, charging prevention members 364 and 365 may be provided at the corners of the attraction platen 60 in the main scanning direction. The charging prevention members 364 and 365 may be provided so as not to overlap the electrode 62 or the electrode 63, or so as to overlap the electrode 62 or the electrode 63. The charging prevention members 364 and 365 may include a material having the same polarity as the material of the top surface of the conveying belt 353. More specifically, if the material of the top surface of the conveying belt 353 has a polarity that tends to be charged with positive charge, a material that tends to be charged with positive charge may be used in the charging prevention members 364 and 365. On the other hand, if the material of the top surface of the conveying belt 353 has a polarity that tends to be charged with negative charge, a material that tends to be charged with negative charge may be used in the charging prevention members 364 and 365. The charging prevention members 364 and 365 may include a material having minimum electric resistance.

By forming the charging prevention members 364 and 365 from a material having the same polarity as the top surface of the conveying belt 353 and having minimum electric resistance, the charging prevention members 364 and 365 may be less likely to be charged by the friction between the conveying belt 353 and the charging prevention members 364 and 365. Accordingly, the running load of the conveying belt 353 may be prevented from reaching an excessive level.

Figure 8:
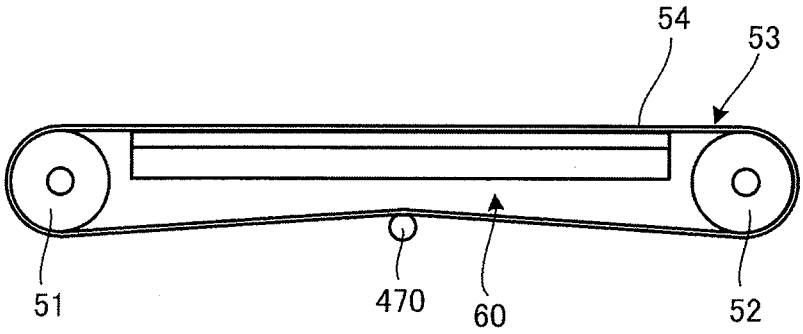
FIG. 8 is a front view of a conveying mechanism according to another embodiment.

Referring to FIG. 8, another embodiment will be described. In this embodiment, a tension roller 470 that functions as a conveying roller to convey the conveying belt 53 and comes into contact with the outer circumferential surface 54 may be provided in addition to the belt rollers 51 and 52. In the embodiment described above, the charging roller 70 may be in contact with the outer circumferential surface 54 of the conveying belt 53. However, in the case where a roller other than the charging roller 70 comes into contact with the outer circumferential surface 54, ink spread by such a roller may cause a short-circuit between the electrodes 62 and 63. In this embodiment, similarly to the charging roller 70, the tension roller 470 may be disposed such that the area of the outer circumferential surface 54 with which the tension roller 470 comes into contact does not extend over the electrodes 62 and 63. Thus, the ink on the outer circumferential surface 54 may be less likely to cause a short-circuit between the electrodes 62 and 63.

Furthermore, in the embodiment described above, the charging roller 70 that performs electric discharge on the sheet P may be used as the roller that presses the sheet P against the outer circumferential surface 54 of the conveying belt 53. However, a roller that does not perform electric discharge on the sheet P but simply performs pressing may be used.

Furthermore, in the embodiment described above, rotary bodies such as the charging roller 70 and the conveying roller may be assumed as the contact members that come into contact with the sheet P and the outer circumferential surface 54 of the conveying belt 53. However, a rotary body, such as a rotary brush, which cleans the sheet P or the outer circumferential surface 54 may be provided. Furthermore, not a rotary body, but a fixed contact member, such as a wiper blade that wipes ink adhered to the outer circumferential surface 54, may be provided.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink jet recording apparatus comprising:

a conveying device configured to move a conveying belt to convey a recording medium, the conveying belt comprising a conveying surface on which the recording medium is placed;

a recording head configured to discharge ink onto the recording medium conveyed by the conveying device;

an attraction device comprising a first electrode, which is integrally formed, and a second electrode, which is integrally formed, the attraction device facing a surface opposite the conveying surface and configured to apply a voltage between the first and second electrodes to attract the recording medium to the conveying surface; and a contact member which comes into contact with the conveying surface, wherein the first and second electrodes are disposed at a distance from each other in the width direction of the conveying belt perpendicular to the conveying direction of the recording medium, wherein the first and second electrodes each comprise a plurality of interdigital portions extending parallel to the conveying direction, wherein a discontinuous contacting area of the conveying surface with which the contact member comes into contact comprises a plurality of continuous areas, wherein each of the continuous areas of the discontinuous contacting area extends over only one of the first electrode and the second electrode in the width direction, and wherein each of the continuous areas of the discontinuous contacting area extends over only one of an interdigital portion of the first electrode and an interdigital portion of the second electrode.

2. The ink jet recording apparatus according to claim 1, wherein the contact member comprises a plurality of rotary bodies arranged at intervals in the width direction.

3. The ink jet recording apparatus according to claim 1, wherein the contact member comes into contact with the recording medium to press the recording medium against the conveying surface.

4. The ink jet recording apparatus according to claim 3, wherein the contact member faces at least one of the first and second electrodes.

5. The ink jet recording apparatus according to claim 1, wherein the conveying device comprises a plurality of rollers configured to convey the conveying belt along a predetermined path, and wherein the contact member is one of the plurality of rollers.

6. An ink jet recording apparatus comprising:

a conveying device configured to move a conveying belt to convey a recording medium, the conveying belt comprising a conveying surface on which the recording medium is placed;

a recording head configured to discharge ink onto the recording medium conveyed by the conveying device;

an attraction device comprising a first electrode, which is integrally formed, and a second electrode, which is integrally formed, the attraction device provided inside the conveying belt and configured to apply a voltage between the first and second electrodes to attract the recording medium to the conveying surface, and the first and second electrodes sandwiching part of the conveying belt between the recording medium on the conveying surface and the first and second electrodes; and a contact member which comes into contact with the conveying surface, wherein the first and second electrodes are disposed at a distance from each other in the width direction of the conveying belt perpendicular to the conveying direction of the recording medium, wherein the first and second electrodes each comprise a plurality of interdigital portions extending parallel to the conveying direction, wherein a discontinuous contacting area of the conveying surface with which the contact member comes into contact comprises a plurality of continuous areas, wherein each of the continuous areas of the discontinuous contacting area extends over only one of the first electrode and the second electrode in the width direction, and wherein each of the continuous areas of the discontinuous contacting area extends over only one of an interdigital portion of the first electrode and an interdigital portion of the second electrode.

7. The ink jet recording apparatus according to claim 6, wherein the contact member comprises a plurality of rotary bodies arranged at intervals in the width direction.

8. The ink jet recording apparatus according to claim 6, wherein the contact member comes into contact with the recording medium to press the recording medium against the conveying surface.

9. The ink jet recording apparatus according to claim 8, wherein the contact member faces at least one of the first and second electrodes.

10. The ink jet recording apparatus according to claim 6, wherein the conveying device comprises a plurality of rollers configured to convey the conveying belt along a predetermined path, and wherein the contact member is one of the plurality of rollers.

* * * * *